US005482143A

United States Patent [19]

Saito

[11] Patent Number: 5,482,143

[45] Date of Patent: Jan. 9, 1996

[54] METHOD OF CONTROLLING A PLURALITY OF ELEVATORS MOVING IN A COMMON HOISTWAY

[75] Inventor: Takaharu Saito, Inazawa, Japan

[73] Assignee: Mitsubishi Denki Kabushiki Kaisha, Tokyo, Japan

[21] Appl. No.: 960,432

[22] PCT Filed: Apr. 8, 1992

[86] PCT No.: PCT/JP92/00441

§ 371 Date: Mar. 10, 1993

§ 102(e) Date: Mar. 10, 1993

[87] PCT Pub. No.: WO92/1841

PCT Pub. Date: Oct. 29, 1992

[30] Foreign Application Priority Data

Apr. 12, 1991 [JP] Japan ..... 3-079392

[51] Int. Cl.[6] ..... B66B 9/00

[52] U.S. Cl. ..... 187/394; 187/292; 187/293

[58] Field of Search ..... 187/386, 383, 187/380, 292, 247, 391, 394, 393, 277, 293

[56] References Cited

U.S. PATENT DOCUMENTS 3,073,417 1/1963 Lusti ..... 187/386

3,730,299 5/1973 Inuzuka et al. ..... 187/382

3,837,436 9/1974 Hirasawa et al. ..... 187/382

4,305,479 12/1981 Bittar et al. ..... 187/386

*Primary Examiner*—Peter S. Wong

*Assistant Examiner*—Robert Nappi

*Attorney, Agent, or Firm*—Leydig, Voit & Mayer

[57] ABSTRACT

The present invention relates to a method of controlling a plurality of elevator cars disposed in a common hoistway. When the amount of time elapsed since a moving elevator has started is within a range which is determined by the position from which the moving elevator has started and the position from which a stopped elevator will start, a determination is made that there is the possibility that the two elevators move in parallel. Hence, the stopped elevator is prevented from starting. When such an amount of time is out of the range, a command is issued to start the stopped elevator. Thus, the stopped elevator is no longer prevented from starting when the amount of time elapsed since the moving elevator has started is out of the range within which the two elevators may move in parallel. The waiting time is minimized during which the elevator is prevented from starting, thus improving reliability.

8 Claims, 4 Drawing Sheets

METHOD OF CONTROLLING A PLURALITY OF ELEVATORS MOVING IN A COMMON HOISTWAY

TECHNICAL FIELD

The present invention relates to a method of controlling elevators which prevents an increase in noise caused by a plurality of elevators moving in parallel in a common hoistway and, more particularly, to a method of controlling elevators which minimizes the range within which parallel movement may be detected and the time during which elevators are prevented from starting so that simplicity and high accuracy can be realized.

BACKGROUND ART

In general, because of the movement of elevators, air inside hoistways flows at high speed around cars, thus generating noise while the elevators are in operation. The noise increases as the gap decreases between the inner surface of the hoistway and a side surface of a car and as the area increases where these two surfaces face.

Also, when a plurality of elevators are arranged, structures have been proposed, for example, in which two elevators are arranged in one hoistway in order to conserve the space of the hoistway. However, when the two elevators move in parallel (in the same direction and close relative positions), noise and vibrations increase markedly. Since such noise makes passengers uneasy, and is unfavorable in terms of operation, various proposals have been made for preventing parallel movement to solve the noise problem.

FIG. 4 is a view illustrating a conventional method of controlling elevators disclosed in, e.g., Japanese Patent Publication No. 54-14381, and shows the relationship between the positions of elevators and the amount of time elapsed since the elevators started. In the drawing, the transverse axis indicates time t[sec], and the ordinate axis indicates the distance h[m] in a direction in which the elevators move. A, $C_1$ and $C_2$ are curves indicating the movement of the elevators when they are accelerated, whereas $B_1$ and $B_2$ are curves indicating the movement of the elevators when they move at a constant speed.

In this case, on the basis of circumstances for other parallel elevators, the time is controlled when an elevator at rest starts from a position O at time $t_0$ so that no other elevators move in the same direction in a range within which this elevator will move. Similarly, the time when other elevators start is controlled in relation to the other elevators moving in the same direction.

For instance, the elevator starting at time $t_0$ from the position O (starting point) is accelerated and moves as indicated by a curve A, and elevators starting from positions $\alpha_1$ and $\alpha_2$ are accelerated and move as indicated by the curves $C_1$ and $C_2$. On the other hand, elevators passing positions $\beta_1$ and $\beta_2$ at a rated speed move as indicated by curves $B_1$ and $B_2$ (which become straight lines in this case).

Here, under a certain condition no elevator can approach another elevator at high speed when the latter elevator starts at time $t_0$ within a distance H[m], wherein the distance H[m] refers to a distance within which two parallel elevators are allowed to approach each other. Conditions satisfying such a condition will be considered.

At this time, if both the distance between the position O and the position $\alpha_2$, and the distance between the position $\alpha_1$ and the position O are expressed as H[m], and if the distance between the positions $\beta_1$ and $\beta_2$ is expressed as 2H[m], then the condition under which there is no elevator between the positions $\beta_1$ and $\beta_2$ at time $t_0$ when a certain elevator starts is sufficient. Also, when an elevator is detected in relation to the speed and position of another elevator, the condition under which there is no elevator which moves at a rated speed between the positions $\beta_1$ and $\beta_2$ is sufficient, and the condition under which there is no elevator which is just about to start between the positions $\alpha_1$ and $\beta_2$ is sufficient.

However, in such a control method, the range (see the shaded portion) within which the elevators may be detected is wide, and even an elevator away from the allowable approach distance H[m] may also be detected. Furthermore, even if the detection range is narrowed in relation to the speed and position, a determination must be made whether other elevators are moving in the rated speed or whether they are just about to start, thus complicating conditions. In addition, as shown in the drawing, the range within which the elevators move in parallel varies according to their speed and position, thus making it difficult to obtain an appropriate detection range.

In the conventional method of controlling elevators, as described above, the range within which parallel movement of elevators may be detected is wide, and conditions are complicated, thus making it difficult to set an appropriate detection range. Therefore, the detection range and the time during which the elevators are prevented from starting cannot be minimized. There is a problem in that the operation of elevators is adversely affected, thus making passengers uneasy while elevators are prevented from starting.

DISCLOSURE OF THE INVENTION

The present invention has been made in order to solve the above problems, and aims to obtain a method which minimizes both the range within which parallel movement can be detected and the time during which elevators are prevented from starting, thereby realizing simplicity and high accuracy and reducing operational problems and the uneasiness of passengers.

According to this invention, there is provided a method of controlling elevators, characterized by determining, when a stopped elevator starts, whether or not there is an elevator moving in the same direction as that in which the stopped elevator will move; determining, when there is a moving elevator, whether or not the amount of time elapsed since the moving elevator has started is within a predetermined range which is determined by a position from which the moving elevator has started and a position from which the stopped elevator will start; preventing the stopped elevator from starting when the amount of time elapsed since the moving elevator has started is within the predetermined range; and instructing the stopped elevator to start when the amount of time elapsed since the moving elevator has started is out of the predetermined range.

BEST MODE FOR CARRYING OUT THE INVENTION

Figure 1:
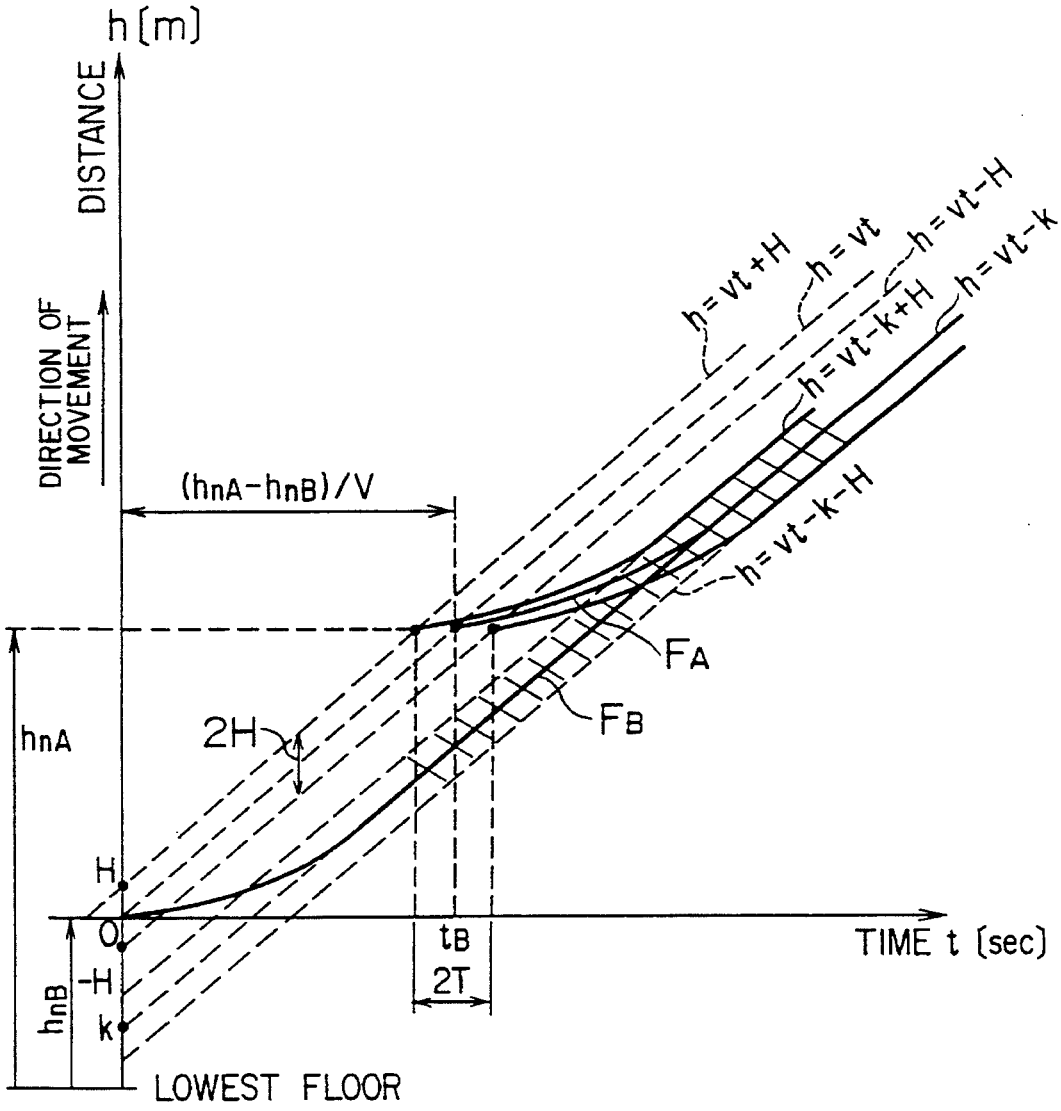
FIG. 1 is a view showing elevator movement characteristics and a method of controlling elevators according to an embodiment of the present invention.

An embodiment of the present invention will be described below with reference to the drawings. FIG. 1 is a view illustrating an embodiment of this invention. The transverse axis indicates time t[sec], and the ordinate axis indicates the distance h[m] in a direction in which elevators move. FA is a curve indicating the movement of an elevator A, and FB is a curve indicating the movement of an elevator B. Here, the elevator A represents an elevator at rest which is about to start, and the elevator B, an elevator which is moving. The time when the elevator B starts is regarded as the starting point of the drawing.

First, the elevator B is accelerated along the movement curve $F_B$ from the time it starts moving, and then moves at a constant speed.

Here, when the rated speed of the elevator is expressed by v[m/sec], the movement curve $F_B$ when the elevator is moving at the constant speed becomes a straight line expressed by $$h=vt-k \tag{1}$$

where k is a coordinate at which (a broken line) portion extending from the straight line intersects with the ordinate axis (distance h).

Next, assuming that a straight line which runs parallel to the straight line h=vt–k through the starting point is considered as a straight line h=vt, and that the elevator A starts at a time $t_B$ which corresponds to a point, for example a stop point, on this straight line h=vt, then because the rated speeds of the elevators A and B are the same, the movement curve $F_A$ of the elevator A and the movement curve $F_B$ of the elevator B become substantially similar in shape. When the elevator A is moving at the constant speed, the elevator A moves along the straight line h=vt–k in parallel to the elevator B. Therefore, when the distance H[m] within which-the two parallel elevators in motion are allowed to approach each other is considered, it may be seen that if the elevator A is prevented from starting when the amount of time $t_B$[sec] which has elapsed since the elevator B has started is within a range between a straight line h=vt+H and a straight line h=vt–H, that is, within a time period 2T between time tB+T and time tB–T, then the parallel movement of the elevators A and B can be avoided.

For example, as shown in the drawing, let it be assumed that the elevator B starts in an upward direction from a floor (starting point) at a height of $hn_B$[m] from the lowest floor, and that after time $t_B$[sec] has elapsed, the elevator A starts in the upward direction from a floor at a height of $hn_A(>hn_B)$ [m] from the lowest floor.

In such a case, the elevators A and B move in parallel to each other, and at this phase, the amount of time $t_B$ which has elapsed since the elevator B has started is expressed by:

$$t_B=(hn_A-hn_B) \tag{2}$$

Also, using the distance H within which the parallel elevators in motion are allowed to approach each other, an allowable amount of time T is expressed as follows:

$$T=H/v \tag{3}$$

As described above, to avoid parallel movement, the elevator A is prevented from starting when the amount of time $tk_B$ which has elapsed since the elevator B has started is within a range which is expressed by the following equation (4):

$$t_B-T<tk_B<t_B+T \tag{4}$$

That is, the amount of time tkB, elapsed since the elevator B started, is compared with the amount of time $t_B$ which is required for the elevator B to move at a speed V from the floor where it starts to the floor where the elevator A starts. The elevator A may be prevented from starting when a difference in the two amounts of time is less than the allowable time T.

Equation (2) is used to express equation (4) as follows:

$$(hn_A-hn_B)/v-T<tk_B<(hn_A-hn_B)/v+T \tag{5}$$

This becomes $$hn_A/v-T<tk_B+hn_B/v<hn_A/v+T \tag{6}$$

Here, when $$hn_A/v=tn_A \tag{7}$$

and $$hn_B/v=tn_B \tag{8}$$

then equation (6) becomes $$tn_A-T<tk_B+tn_B<tn_{A+T} \tag{9}$$

Figure 2:
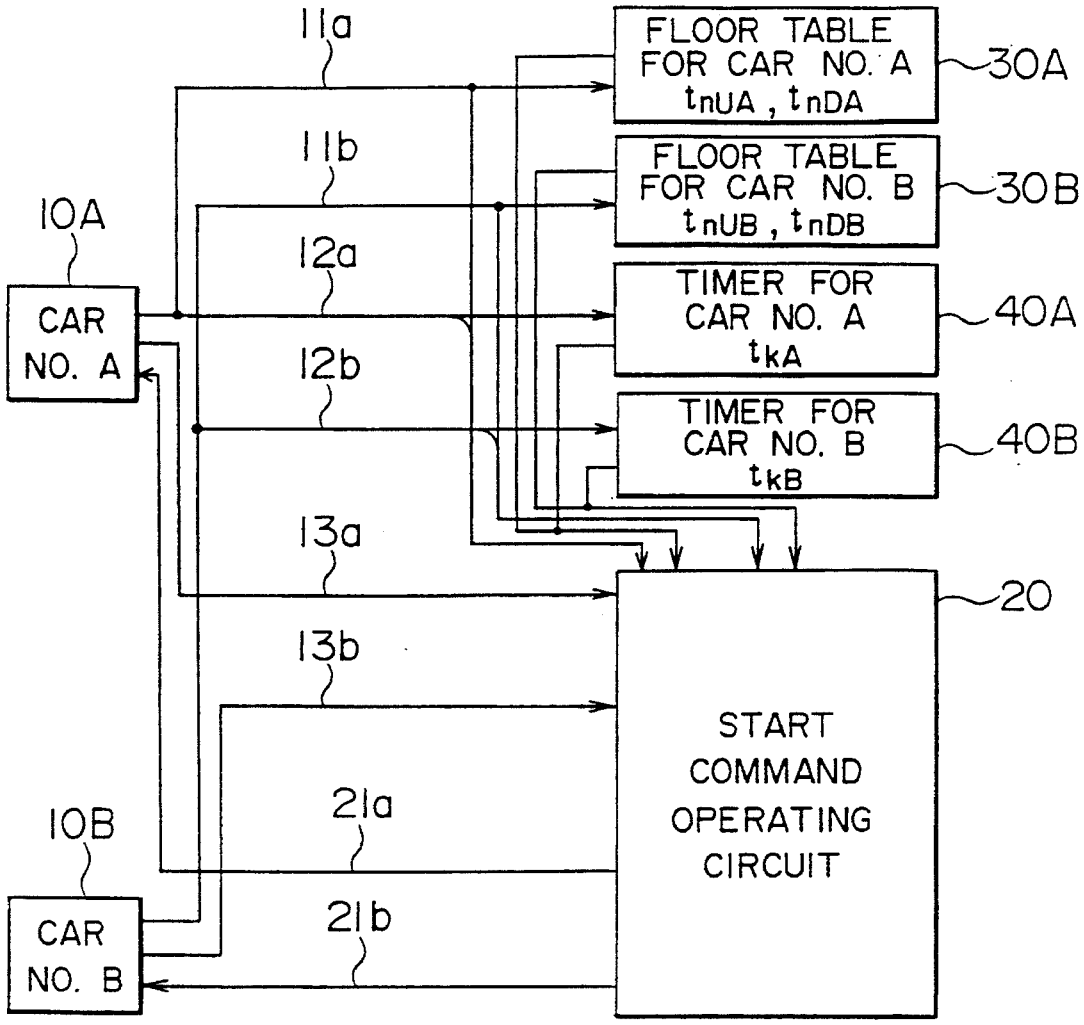
FIG. 2 is a block diagram showing a device which carries out this invention.

Next, FIG. 2 is a block diagram of a control device for carrying out the elevator control method shown in FIG. 1. 10A denotes an elevator A; 10B, an elevator B; 20, a circuit for computing a start command; 30A, a table indicating the floors of the elevator 10A; 30B, a table indicating the floors of the elevator 10B; 40A, a timer for calculating the amount of time the elevator 10A has moved; and 40B, a timer for calculating the amount of time the elevator 10B has moved. The output values of the tables 30A and 30B and the count timers 40A and 40B are input to the start command computing circuit 20.

The tables 30A and 30B respectively store reference values $tn_{UA}$ and $tn_{DA}$ and $tn_{UB}$ and $tn_{DB}$ of the amounts of time the elevators 10A and 10B have moved, which reference values correspond to floors of the elevators 10A and 10B. That is, in the case of an upward direction, a value is stored which is obtained from distances $hn_{UA}$ and $hn_{UB}$ from the lowest floor of all floors and by using:

$$tn_{UA}=hn_{UA}/v \tag{10}$$

and $$tn_{UB}=hn_{UB}/v \tag{11}$$

In the case of a downward direction, a value is stored which is obtained from distances $hn_{DA}$ and $hn_{DB}$ from the highest floor of all floors and by using:

$$tn_{DA}=hn_{DA}/v \tag{12}$$

and $$tn_{DB}=hn_{DB}/v \tag{13}$$

The timers 40A and 40B calculate the amounts of time $t_{kA}$ and $t_{kB}$ the elevators 10A and 10B have actually moved. While the elevators 10A and 10B are at rest, a value is set which is greater than the amount of time required to move from the lowest floor to the highest floor.

11*a* to 13*a* denote signals output from the elevator 10A; 11*b* to 13*b* denote signals output from the elevator 10B; and 21*a* and 21*b* denote signals output from the start command computing circuit 20.

11*a* denotes a floor and direction signal for the elevator 10A, which signal indicates on which floor the elevator 10A is and the direction in which the elevator 10A will move; and 11*b* denotes a floor and direction signal for the elevator 10B, which signal indicates on which floor the elevator 10B is and the direction in which the elevator 10B will move. 12*a* denotes an elevator-in-operation signal which indicates that the elevator 10A is in operation; 12*b*, an elevator-in-operation signal which indicates that the elevator 10B is in operation; 13*a*, an elevator start request signal which indicates start requests for the elevator 10A; and 13*b*, an elevator start request signal which indicates start requests for the elevator 10B. 21*a* denotes an elevator start command signal indicating the start command of the elevator 10A, and 21*b* denotes an elevator start command signal indicating the start command of the elevator 10B.

The floor and direction signals 11*a* and 11*b* and the elevator-in-operation signals 12*a* and 12*b* are separately input to the start command computing circuit 20, the tables 30A and 30B, and the count timer 40A and 40B.

Thus, the tables 30A and 30B output reference times $tn_{UA}$, $tn_{DA}$, $tn_{UB}$ and $tn_{DB}$ to the start command computing circuit 20, which reference times correspond to the floors and directions indicated by the floor and direction signals 11*a* and 11*b*. The count timers 40A and 40B start a counting operation on the basis of the elevator-in-operation signals 12*a* and 12*b*. The start request signals 13*a* and 13*b* are input to the start command computing circuit 20. The start command signals 21*a* and 21*b* are separately input to the elevators 10A and 10B.

Next, with reference to the flowchart of FIG. 3, the specific operation of ]FIG. 2 will be described. For example, when the elevator 10A starts, first, in step S1 it outputs the start request signal 13*a* for the elevator 10A to the start command computing circuit 20. The start command computing circuit 20, which has received the start request signal 13*a*, computes, in the following way, the possibility that the elevator 10A will move in parallel to another elevator (the elevator 10B in this case).

That is, in step S2, a determination is made whether the start request signal 13*b* for the elevator 10B is generated. If it has been generated, the elevator 10A stands ready Until the elevator 10B starts and there is no start request signal 13*b* for the elevator 10B. In step S2, if a determination is made that there is no start request signal 13*b* for the elevator 10B, then in step S3 a determination is made, on the basis of the signals 11*b* and 12*b*, which direction the elevator 10B is moving, to confirm whether the elevator 10B is moving in the same direction as that in which the elevator 10A moves.

In step S3 if the elevators 10A and 10B move in the same direction, a determination is made whether or not the elevator 10A (or 10B) is moving upward in step S4. The movement direction is specified for the following computations. That is, in step S4, if a determination is made that the elevator is moving upward, the flow proceeds to step S5, where a determination is made whether the amount of time $tk_B$ which has elapsed since the elevator B has started and which has been output from the count timer 40B satisfies $$tnu_A - T < tk_B + tnu_B < tnu_A + T \quad (14),$$

this determination being based upon reference times $tn_{UA}$ and $tn_{UB}$ which are obtained from the tables 30A and 30B.

On the other hand, if a determination is made that the elevator is moving downward, the flow proceeds to step S6, where a determination is made whether the amount of time $tk_B$ satisfies $$tn_{DA} - T < tk_B + tn_{DB} < tn_{DA} + T \quad (15),$$

this determination being based upon reference times $tn_{DA}$ and tnDB which are obtained from the tables 30A and 30B.

If the amount of time $tk_B$ which has elapsed since the elevator 10B has started satisfies either equation (14) or (15), the results of the determination in step S5 or S6 are regarded as a possibility that the elevators 10A and 10B will move in parallel, and the elevator 10A is prevented from starting. In other words, the start command computing circuit 20 does not output the start command signal 21*a* to the elevator 10A. The start command computing circuit 20 again inputs from the count timer 40B a new amount of time $tk_B$ which has elapsed since the elevator B has started, and then performs the determination in step S5 or S6. In this way, step S5 or S6 is performed repeatedly until the amount of time $tk_B$ which has elapsed since the elevator 10B has started is out of a range which is indicated by equation (14) or (15).

And, if the amount of time tkB which has elapsed since the elevator 10B has started no longer satisfies equation (14) or (15), a determination is made that there is no possibility that the elevators 10A and 10B will move in parallel. The flow proceeds to step S7, where the start command computing circuit 20 outputs the start command signal 21*a* to the elevator 10A and the elevator 10A is no longer prevented from starting.

On the other hand, in step S3, if a determination is made that the elevators do not move in the same direction, there is no possibility that the elevators will move in parallel. The flow immediately proceeds to step S7, where the start command signal 21*a* for the elevator 10A is output.

Figure 4:
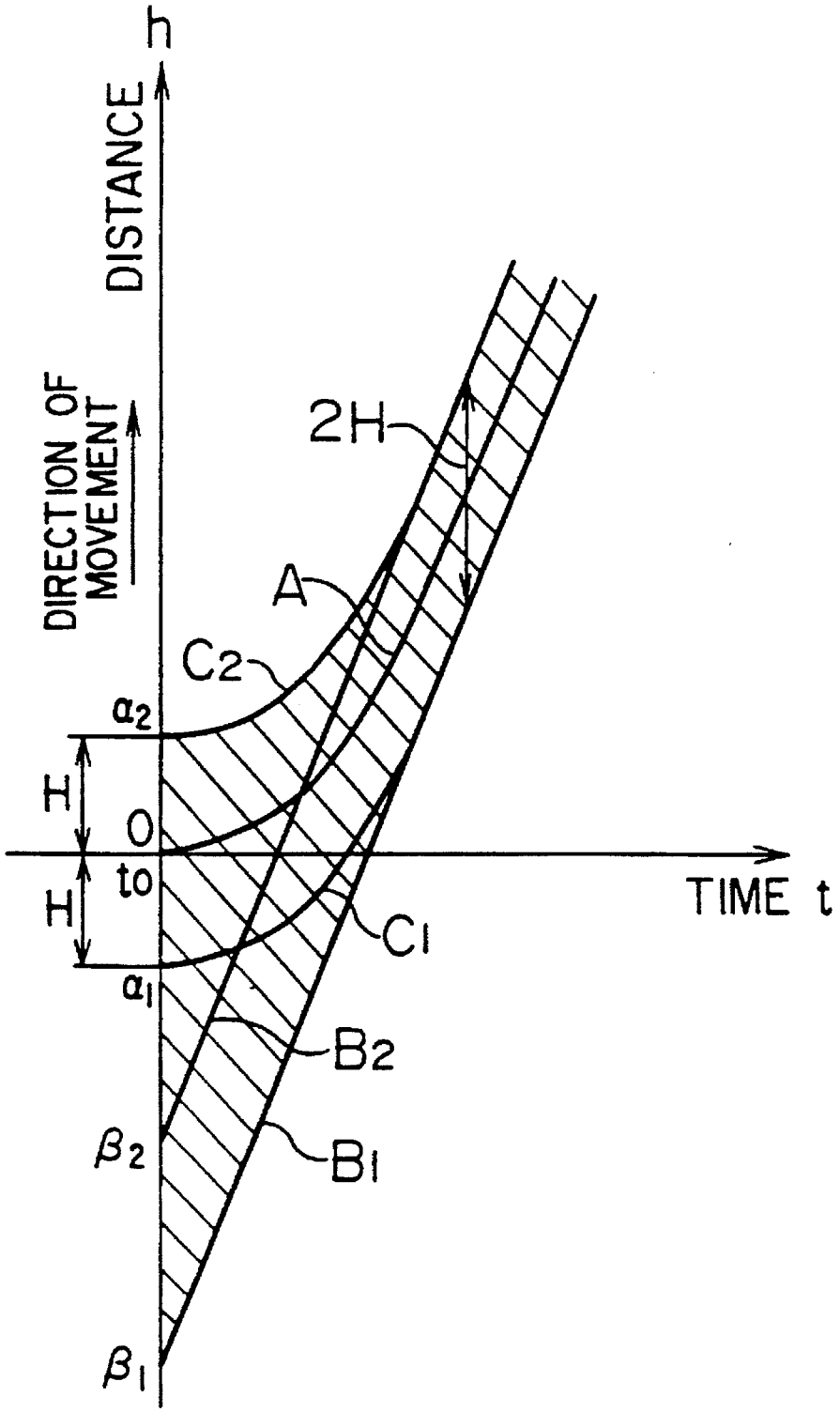
FIG. 4 is a view showing elevator movement characteristics and the conventional method.

In this way, the elevator 10A can be prevented from starting in a detection range indicated by the shaded portion in FIG. 1. This detection range is minimized, as apparent when it is compared with the conventional detection range shown in FIG. 4. Thus, the detection and control process are simplified, and control accuracy is increased. Furthermore, the time during which the elevator is prevented from starting is minimized, thus decreasing the uneasiness of passengers.

Although in the above embodiment, a case is described where the elevator 10B moves before the elevator 10A starts, the same control process as mentioned above may be performed in a case where the elevator 10A moves before the start of the elevator 10B. Also, the same control process may be performed in a case where a plurality of elevators, e.g., two or more elevators, are controlled.

The time when the elevators start is not mentioned, however, the time when the door starts closing may be regarded as the start time, or the time when the elevator starts moving after the door has closed may also be regarded as the start time. Furthermore, when an elevator, the start time of which is the time when the elevator starts moving, is compared with an elevator, the start time of which is the time when the door starts closing, the amount of time required for closing the door may be corrected.

A door which has started closing may be operated reversely to temporarily open it, and this may be used as a method of preventing an elevator at rest from starting. In such a case, if the elevator moves at high speed, and if the time required for reversing the door to open it is sufficient for the time required for preventing the elevator from starting, the elevator may be started immediately after the door has closed again, without performing the computational determination in step S5 or S6.

Figure 3:
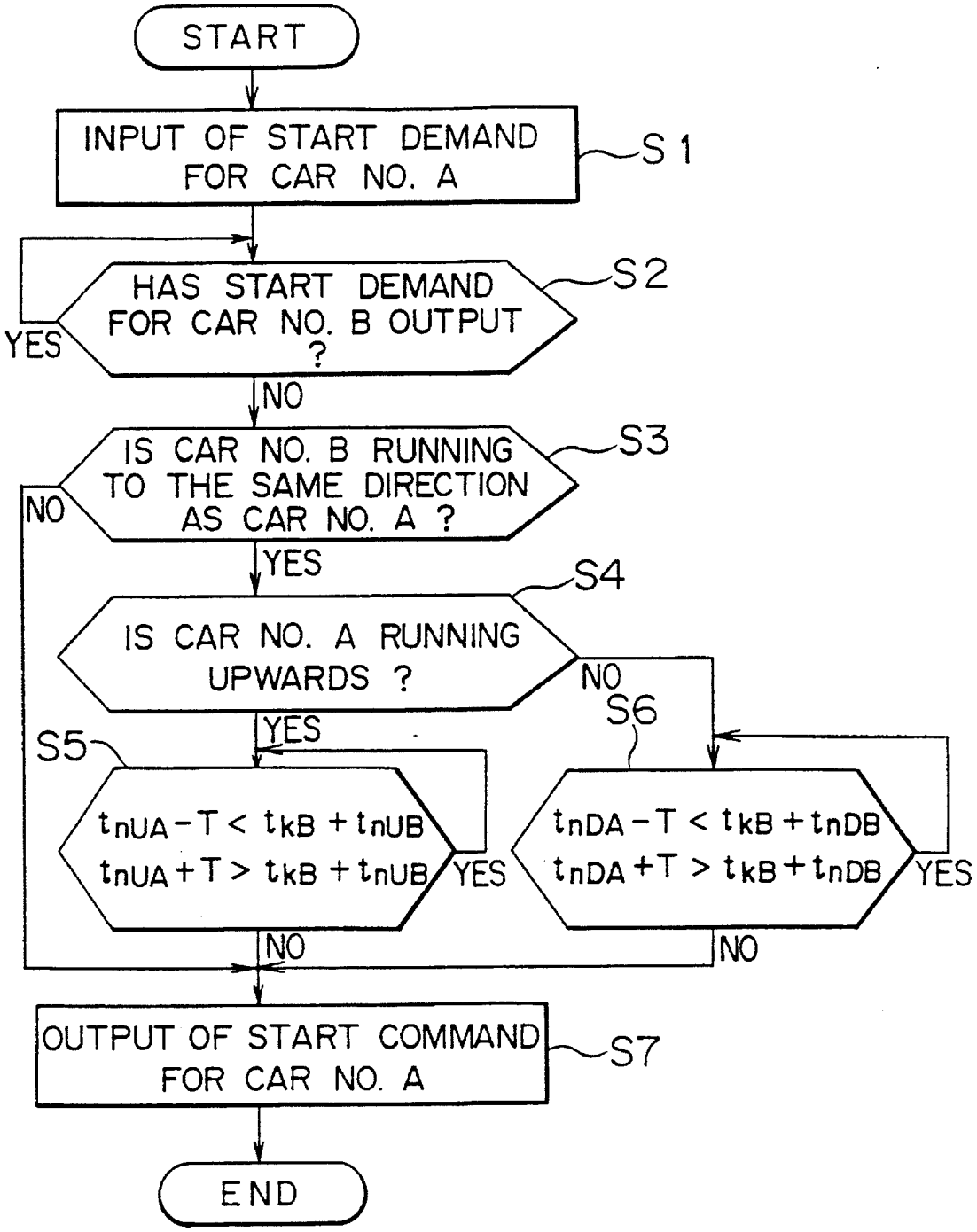
FIG. 3 is a flowchart showing the operation of the embodiment.

In step S3 of FIG. 3, only if the elevators move in opposite directions, is a determination made that there is no possibility that the elevators will move in parallel. However, as regards elevators moving in a small range, such as one between two or three floors, because the time during which the elevators move at a constant speed is short, a determination can be made that there is no possibility that the elevators will move in parallel, even if the elevators move in the same direction. When there is an express route, only elevators moving in the express route may be detected to determine whether they move in parallel. Such conditions may be determined on the basis of car calls and floor calls assigned to the car.

Also, the above embodiment has been described in which the rated speeds of elevators are the same. However, when the rated speeds are significantly different, one elevator moves immediately away from another elevator, even if they move in parallel. It is therefore possible not to detect such elevators.

I claim:

1. A method of controlling a plurality of elevators disposed in a common hoistway, comprising:

determining, when a stopped elevator starts, whether there is an elevator moving in the same direction as that in which said stopped elevator will move;

determining, when there is an elevator moving in the same direction as that in which said stopped elevator will move, whether the amount of time elapsed since said moving elevator has started is within a predetermined range which is determined by a position from which said moving elevator has started and a position from which said stopped elevator will start including comparing an amount of time elapsed since the moving elevator has started (A) with an amount of time required for the moving elevator to move at a constant speed from the position from which the moving elevator has started to the position from which the stopped elevator will start (B);

preventing said stopped elevator from starting when the amount of time elapsed since said moving elevator has started is within said predetermined range including preventing said stopped elevator from starting when a difference between A and B is less than a predetermined amount; and instructing said stopped elevator to start when the amount of time elapsed since said moving elevator has started is out of said predetermined range.

2. A method of controlling a plurality of elevators as claimed in claim 1 characterized in that a first reference time required for the respective elevators to move at a constant speed from the lowest floor to floors above and a second reference time required for the respective elevators to move at the constant speed from the highest floor to floors below are stored beforehand, time required for said moving elevator to move from the position from which it has started to the position from which said stopped elevator will start being computed by using one of the reference times corresponding to the position of said stopped elevator and a direction in which said stopped elevator will move and by using one of the reference times corresponding to the position of said moving elevator and a direction in which said moving elevator is moving.

3. A method of controlling a plurality of elevators as claimed in claim 2 characterized in that if the direction in which said stopped elevator will move is an upward direction, computation is performed by using the first reference time required to move at the constant speed from the lowest floor to the floors above, and if the direction in which said stopped elevator will move is a downward direction, computation is performed by using the second reference time required to move a: the constant speed from the highest floor to the floor below.

4. A method of controlling a plurality of elevators as claimed in claim 1 characterized in that time when the respective elevators start is time when the doors of the respective elevators start closing.

5. A method of controlling a plurality of elevators as claimed in claim 1 characterized in that time when the respective elevators start is time when the respective elevators start after the doors of the elevators have closed.

6. A method of controlling a plurality of elevators as claimed in claim 1 characterized in that said stopped elevator is prevented from starting by reversing the door which has started closing to open it.

7. A method of controlling a plurality of elevators as claimed in claim 1 characterized in that an elevator moving in a small range between two or three floors is not detected whether it moves in parallel, even if the elevator moves in the same direction as that in which said stopped elevator will move.

8. A method of controlling a plurality of elevators moving in a common hoistway, comprising:

assigning a direction to a first elevator, the first elevator being at rest at a rest position;

detecting a second elevator moving in the direction assigned to the first elevator;

detecting the amount of time elapsed since the second elevator began to move;

comparing the amount of time elapsed since the second elevator began to move to a predetermined range of times, the predetermined range of times being determined based upon a position from which the second elevator has started and the rest position of the first elevator;

maintaining the first elevator at rest when the amount of time elapsed since the second elevator began to move is within a predetermined range; and starting the first elevator when the amount of time elapsed since the second elevator began to move is outside of the predetermined range.

* * * * *

UNITED STATES PATENT AND TRADEMARK OFFICE

CERTIFICATE OF CORRECTION

PATENT NO. : 5,482,143

DATED : January 9, 1996

INVENTOR(S) : Saito

It is certified that error appears in the above-indentified patent and that said Letters Patent is hereby corrected as shown below:

Column 8, Line 16, change "a:" to --at--;

Line 17, change "floor" to --floors--.

Signed and Sealed this

Twenty-fifth Day of June, 1996

*Attest:*

BRUCE LEHMAN

*Attesting Officer*

*Commissioner of Patents and Trademarks*